United States Patent [19]
Monkelbaan
[11] 4,444,486
[45] Apr. 24, 1984

[54] THREE-ROLL COLD PRESSURE FUSE FOR FIXING TONER IMAGES TO COPY SUBSTRATES INCLUDING AN OVERSKEWED ROLL

[75] Inventor: Edwin R. Monkelbaan, Fairport, N.Y.

[73] Assignee: Xerox Corporation, Stamford, Conn.

[21] Appl. No.: 387,061

[22] Filed: Jun. 10, 1982

[51] Int. Cl.[3] ..... G03G 15/20

[52] U.S. Cl. ..... 355/3 FU; 219/216; 219/388

[58] Field of Search ..... 355/3 FU; 219/216, 388; 430/98

[56] References Cited

U.S. PATENT DOCUMENTS

| | | | |
|---|---|---|---|
| 3,658,407 | 4/1972 | Kitano et al. | 350/96 B |
| 3,854,975 | 12/1974 | Brenneman et al. | 117/21 |
| 3,874,894 | 4/1975 | Pederson | 355/3 FU |
| 3,947,106 | 3/1976 | Hamaguchi et al. | 355/1 |
| 3,977,777 | 8/1976 | Tanaka et al. | 355/1 |
| 3,988,061 | 10/1976 | Root | 355/3 FU |
| 4,192,229 | 3/1980 | Tsunoi et al. | 100/158 |
| 4,259,920 | 4/1981 | Sasaki | 118/116 |
| 4,305,330 | 12/1981 | Ogihara | 430/98 |
| 4,341,458 | 7/1982 | Glasa et al. | 355/3 FU |
| 4,356,764 | 11/1982 | Haugen | 355/3 FU |

FOREIGN PATENT DOCUMENTS

| | | | |
|---|---|---|---|
| 2607271 | 4/1977 | Fed. Rep. of Germany | 355/3 FU |
| 56-107279 | 8/1981 | Japan | 355/3 FU |
| 56-137376 | 10/1981 | Japan | 355/3 FU |

*Primary Examiner*—Richard L. Moses

[57] ABSTRACT

A cold pressure fuser comprising three rolls two of which have their axes parallel to each other and form a nip through which copy sheets having toner images pass. The third roll serves to apply the required load to the other two rolls to create the required pressure in the nip therebetween. The axis of the third roll is overskewed relative to the other rolls such that the distribution of the load between it and the roll which it contacts is peaked at its center and zero at its ends. A pair of load releasing arms are provided to remove the loading from the rolls to thereby facilitate paper jam clearance.

6 Claims, 3 Drawing Figures

THREE-ROLL COLD PRESSURE FUSE FOR FIXING TONER IMAGES TO COPY SUBSTRATES INCLUDING AN OVERSKEWED ROLL

BACKGROUND OF THE INVENTION

This invention relates generally to xerographic copying apparatus, and more particularly, it relates to fixing of particulate thermoplastic material arranged in image configuration by passing the substrate carrying the images between a pair of unheated pressure engaged roll members forming part of a three roll pressure fuser.

In the process of xerography, a light image of an original to be copied is typically recorded in the form of a latent electrostatic image upon a photosensitive member with subsequent rendering of the latent image visible by the application of particulate thermoplastic material, commonly referred to as toner. The visual toner image can be either fixed directly upon the photosensitive member or transferred from the member to another support, such as a sheet of plain paper, with subsequent affixing of the image thereto, the most common method of affixing comprising the simultaneous application of heat and pressure.

In order to affix or fuse electroscopic toner material onto a support member by the simultaneous application of heat and pressure it is necessary to elevate the temperature of the toner and simultaneously apply pressure sufficient to cause the constituents of the toner to become tacky and coalesce. This action causes the toner to flow to some extent into the fibers or pores of support member or otherwise upon the surface thereof. Thereafter, as the toner material cools, solidification thereof occurs causing the toner material to be bonded firmly to the support member. In both the xerographic as well as the electrographic recording arts, the use of the above-described fuser for fixing toner images onto a support member is old and well known.

It is equally well known that heat and pressure fusing of toner images has various drawbacks. For example, a large quantity of electrical power is required to raise the surface temperature of the fuser roll to a suitable temperature. Approximately 70% to 80% of the total power consumed by the entire copying machine is needed for this type of fuser. Another disadvantage resides in the fact that heat and pressure fusers require a relatively long warm up period. Moreover, the fuser roll is heated during stand-by which results in a waste of thermal energy. As will be appreciated, the other components of the machine may be adversely affected by the heat dissipated into the machine environment and in the case of very high speed reproducing apparatus cooling systems are required.

In view of the disadvantages noted above with respect to heat and pressure fusing, other types of fusers have been pursued. One of the more actively pursued areas in this respect is cold pressure fusers. First attempts to fuse toner images by pressure along (i.e. without the aid of heat) were accomplished by a pair of rolls to which the required pressure was applied. Due to the high pressures involved, problems such as roll bending were encountered. Such a problem has been solved by skewing the two rolls relative to each other or by crowning or by centrally supporting one or both of the rolls.

Further developments in the area of cold pressure fusing resulted in three roll systems which, in general, are less expensive than the two roll systems because the rolls are smaller. An example of a two roll system is described in U.S. Pat. No. 3,854,975 while a three roll system is described in U.S. Pat. Nos. 4,192,229 and 4,259,920.

Not only are known two roll systems more expensive than the three roll fusers they also are less subject to paper wrinkle. This is because in a two-roll fuser the rolls are usually skewed in order to preclude adverse bending of the rolls when the load is applied. Skewed rolls tend to induce corner curl in the copy sheets and laterally translate the paper in the nip, the later of which can be a problem for short paper path configurations. With a three-roll fuser the axes of the rolls forming the nip through which the copy sheets pass can be parallel while the third roll which applies the load can be skewed. Such an arrangement is disclosed in U.S. Pat. No. 4,259,920. As illustrated therein the skewed backup or loading roll is substantially shorter than the non-skewed rolls. Alternatively the rolls forming the nip have been skewed but this arrangement causes proper wrinkle.

Three-roll systems where the nip is formed by two parallel rolls also have an advantage over two-roll systems in that once they are set up using one size paper they can accommodate various size papers. In a simply supported two-roll skewed system which is set up using one size paper, a change in paper size results in a change in load distribution which results in a change in deflection of each roll in the opposite direction.

I have found that the three-roll fuser with the third roll skewed is prone to edge wear which results in poor copies. Edge wear is the wear on the pressure roll where it is contacted by the edges of the skewed roller. Edge wear is caused by the loading forces exerted at the edges of the skewed roll where they contact the pressure roll. Thus, do to the forces exerted by the edges of the skewed loading roll on the pressure roller it becomes grooved. Since the grooves are well within the paper path these grooves adversely affect the final copy.

Another problem that I have found with roll pressure fusers is that paper jams are difficult to clear because these fusers do not provide for unloading of the rolls to facilitate jam clearance. In prior art cold pressure fusers, the loading of the rolls is accomplished at each end of the roll to which loading is required. In a two-roll arrangement, each end of the pressure roll is provided with a separate loading device such as a spring and a set screw. The set screw is adjustable to set the desired load which requires some means for measuring the load exerted in the nip. Once the two set screws have been adjusted to the required load they cannot be disturbed without redoing the entire procedure. Accordingly, a paper jam has to be cleared with the load on the rolls.

SUMMARY OF THE INVENTION

Briefly, the present invention comprises a three-roll pressure fuser wherein a fuser roll is mounted intermediate a pair of frame members and a pressure roller is floatingly mounted above said fuser roller and supported thereby. A backup or loading roller is mounted in an overskewed relation to said fuser and pressure rollers which are disposed such that their axes are parallel. By overskewed is meant that the axis of the last-mentioned roll is angulated with respect to the axes of the other rolls such that the pressure exerted between the overskewed roll and the pressure roll is graduated from the center of the roll outwardly along its axis such that there is a peak force at the center and zero force at the ends. The present invention is further characterized by the provision of unloading structure for removing the nip pressure between the fuser and pressure rollers to thereby facilitate paper jam clearance.

Other aspects of the present invention will become apparent as the following description proceeds with reference to the drawings wherein:

DETAILED DESCRIPTION OF THE PREFERRED EMBODIMENT OF THE INVENTION

While the present invention will hereinafter be described in conjunction with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
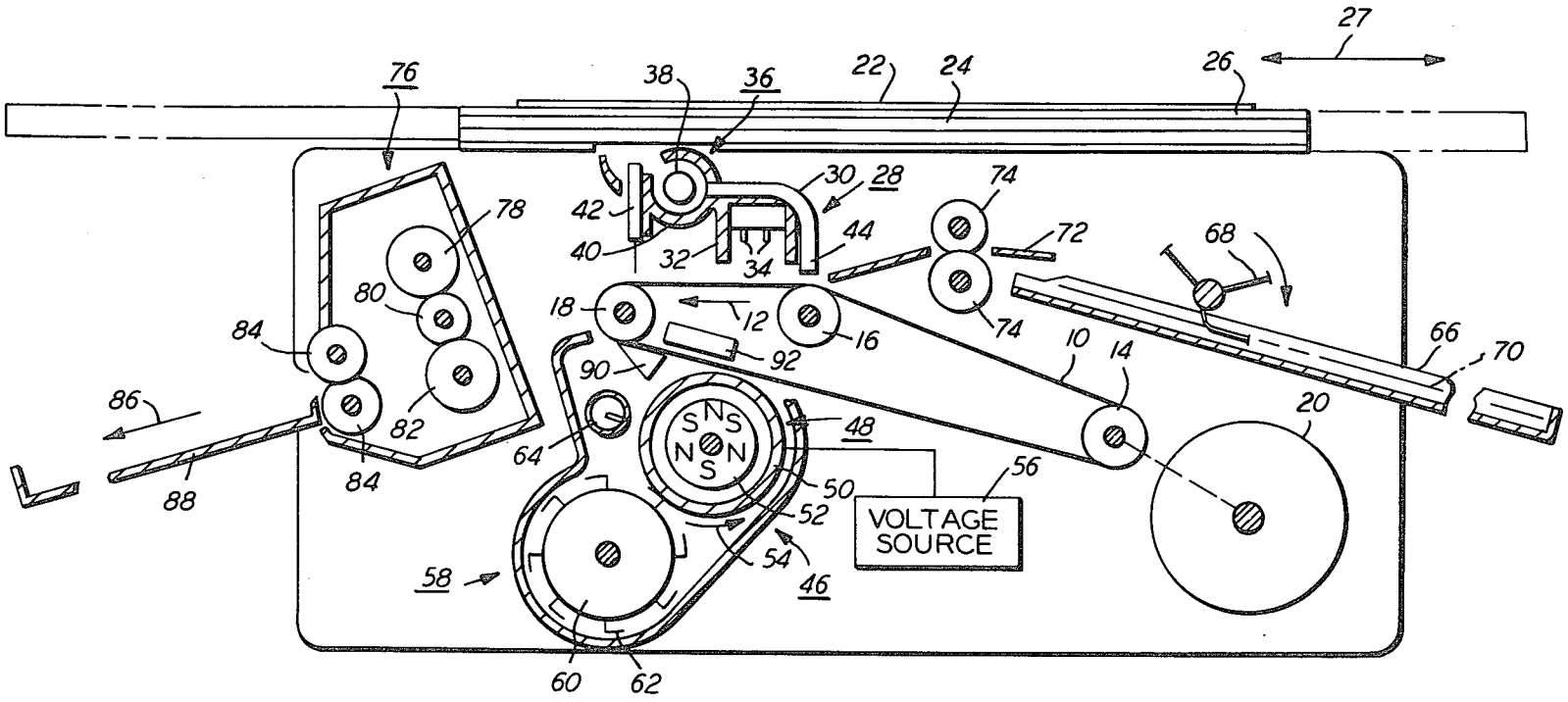
FIG. 1 depicts a schematic elevational view of an electrophotographic printing machine incorporating the features of the present invention therein.

For a general understanding of the features of the present invention, reference is had to the drawings. In the drawings, like reference numerals have been used throughout to designate identical elements. FIG. 1 schematically depicts the various components of an electrophotographic Printing machine incorporating the features of the present invention therein. It will become evident from the following discussion that these features are equally well suited for use in a wide variety of electrostatographic printing machines, and are not necessarily limited in their application to the particular embodiment depicted herein.

As shown in FIG. 1 of the drawings, the electrophotographic printing machine employs a belt 10 having a photoconductive surface deposited on a conductive substrate. Preferably, the photoconductive surface is made from an organic photoconductor with the conductive substrate being made from an aluminum alloy. Belt 10 moves in the direction of arrow 12 to advance successive portions of the photoconductive surface through the various processing stations disposed adjacent the path of movement thereof. Rollers 14, 16 and 18 maintain belt 10 under suitable tension. Roller 14 is coupled to drive motor 20. Rollers 16 and 18 are mounted in suitable bearings to rotate freely and act as idler rollers. Motor 20 drives roller 14 to advance belt 10 in the direction of arrow 12.

An original document 22 is disposed facedown upon a transparent platen 24. Platen 24 is mounted in a frame 26 which is capable of reciprocating motion in a horizontal plane as indicated by arrow 27. Belt 10 is driven at a linear velocity substantially equal to the linear velocity of platen 24. Belt 10 moves in a recirculating path. In order to reproduce a copy of an original document, belt 10 performs two complete cycles of movement through the recirculating path.

During the first cycle, belt 10 advances a portion of the photoconductive surface initially beneath a charging-transferring unit, indicated generally by the reference numeral 28. Charging-transferring unit 28 includes a corona generating device 30 which charges the photoconductive surface of belt 20 to a relatively high substantially uniform potential. Corona generating device 30 includes a U-shaped shield 32 having an open end facing the photoconductive surface of belt 10. Two rows of substantially equally spaced pins 34 are supported such that they extend outwardly from shield 32 toward the open end thereof.

Next, the charged portion of photoconductive surface 12 is advanced beneath a combined exposing-discharging unit, indicated generally by the reference numeral 36. Combined exposing-discharging unit 36 includes a light source 38, preferably an elongated tungsten lamp. Light source 38 is disposed stationarily beneath platen 24. An opaque shield 40 surrounds light source 38. Shield 40 has a slit therein so that the light rays from light source 38 are projected onto original document 22 disposed facedown on transparent platen 24. As platen 24 moves to the left as viewed in FIG. 1, successive incremental portions of original document 22 are illuminated. Light rays reflected from original document 22 are transmitted through a bundle of image transmitting fibers, indicated generally by the reference numeral 42. Image transmitting fibers 42 are bundled gradient index optical fibers. U.S. Pat. No. 3,658,407 issued to Kitano et al in 1972 describes a light conducting fiber made of glass or synthetic resin which has a refractive index distribution in cross section thereof that varies consecutively and parabolically outwardly from a center portion thereof. Each fiber acts as a focusing lens to transmit part of an image placed at, or near, one end thereof. An assembly of fibers, in a staggered two-row array, transmits and focuses a complete image of the object. The fiber lenses are produced under the tradename "SELFOC;" the mark is registered in Japan and owned by Nippon Sheet Glass Company, Limited. These gradient index lens arrays are used as a replacement for conventional optical systems in electrophotographic printing machines, such use being disclosed in U.S. Pat. No. 3,947,106 issued to Hamaguchi et al in 1976 and U.S. Pat. No. 3,977,777 issued to Tanaka et al in 1976. The relevant portions of the foregoing patents are hereby incorporated into the present disclosure. The light rays reflected from the original document form a light image which are transmitted through the image transmitting fibers onto the charged portions of the photoconductive surface of belt 10 to dissipate the charge thereon in accordance with the patern of the light image. This records an electrostatic latent image on the photoconductive surface of belt 10 which corresponds to the informational areas contained within original document 22. Combined exposing-discharging unit 36 also includes a light transmitting glass fiber optical tube 44. One end of optical tube 44 is disposed closely adjacent to light source 38. The other end of optical tube 44 is positioned closely adjacent to the photoconductive surface of belt 10 prior to combined charging-transferring unit 28 in the direction of movement of belt 10, as indicated by arrow 12.

Thereafter, belt 10 advances the electrostatic latent image recorded on the photoconductive surface to a combined developing-cleaning unit, indicated generally by the reference numeral 46. Combined developing-cleaning unit 46 includes a developer roller, indicated generally by the reference numeral 48. Developer roller 48 comprises an elongated cylindrical magnet 52 mounted interiorly of tubular member 50. Tubular member 50 rotates in the direction of arrow 54. Voltage source 56 is electrically connected to tubular member 50 so as to electrically bias tubular member 50 to a potential ranging from about 50 volts to about 500 volts. A specific selected voltage level depends upon the potential level of the latent image and that of the background areas. During development, the biasing voltage is intermediate that of the background and latent image. Conveyor 58 which comprises a cylindrical member 60 having a plurality of buckets 62 thereon advances developer material comprising magnetic carrier granules having toner particles adhering triboelectrically thereto upwardly to developer roller 48. Developer roller 48 attracts the developer material thereto. As tubular member 50 rotates in the direction of arrow 54. The developer material is transported into contact with the latent image and toner particles are attracted from the carrier granules thereto. In this way, a toner powder image is formed on the photoconductive surface of belt 10. Auger 64 mixes the toner particles with the carrier granules. Preferably, tubular member 50 is made from a non-magnetic material such as aluminum having the exterior circumferential surface thereof roughened. Magnetic member 52 is made preferably from barrium ferrite having a plurality of magnetic poles impressed thereon. A metering blade, not shown, may be employed to define a gap between tubular member 50 through which the developer material passes. This gap regulates the quantity of developer material being transported into contact with the electrostatic latent image recorded on the photoconductive surface of belt 10.

After the toner powder image is formed on the photoconductive surface of belt 10, belt 10 returns the toner powder image to the combined charging-transferring unit 28 for the start of the second cycle. At this time, a copy sheet 66 is advanced by sheet feeder 68 to combined charging-transferring unit 28. The copy sheet is advanced in a timed sequence so as to be in synchronism with the toner powder image formed on the photoconductive surface of belt 10. In this way, one side of the copy sheet contacts the toner powder image at combined charging-transferring unit 28. Preferably, sheet feeder 68 includes a rotatably mounted cylinder having a plurality of spaced, flexible vanes extending outwardly therefrom. The free end of each vane successively engages the uppermost sheet 66 of stack 70. As feeder 68 rotates, sheet 66 moves into chute 72. Registration roller 74 advances sheet 66, in synchronism with the toner powder image on the photoconductive surface of belt 10, to combined charging-transferring unit 28.

Corona generating device 30 of combined charging-transferring unit 28 sprays ions onto the backside of the copy sheet. This attracts the toner powder image from the photoconductive surface of belt 10 to the sheet. After transfer, the sheet continues to move with belt 10 until the beam strength thereof causes it to strip therefrom as belt 10 passes around roller 18. As the sheet separates from belt 10, it advances to a fuser assembly, indicated generally by the reference numeral 76. Preferably, fuser assembly 76 includes a backup roller 78, a pressure roller 80 and a fuser roller 82. The sheet passes between rollers 80 and 82, the toner images contacting the fuser roller 82 whereby pressure is applied to permanently affix the toner powder images to the copy sheet. Thereafter, exiting rollers 84 advance the sheet in the direction of arrow 86 onto catch tray 88 for subsequent removal from the printing machine by the operator.

As belt 10 advances the residual toner particles adhering to the photoconductive surface to combined developing-cleaning unit 46, a toner particle disturber 90 smears the residual particles adhering to the photoconductive surface thereby facilitating removal thereof by the unit 46. Toner Particle disturber 90 includes an elastomeric or foam member extending across the width of belt 10. During the first cycle, the elastomeric member is spaced from the photoconductive surface of belt 10. During the second cycle, a motor driven cam moves the elastomeric member into contact with the photoconductive surface so as to smear the residual toner particles prior to the removal thereof from the photoconductive surface. In view of a motor driven cam, one skilled in the art will appreciate that a solenoid may be employed to move the elastomeric member of the toner particle disturber 90 into and out of contact with the photoconductive surface of belt 10. After the residual toner particles have been smeared, the photoconductive surface of belt 10 is illuminated by an electroluminescent light strip 92 disposed interiorly of belt 10. Electroluminescent strip 92 is positioned between tubular member 50 and toner particle disturber 90. This further reduces the charge attracting residual toner particles to the photoconductive surface of belt 10. Thereafter, combined developing-cleaning unit 46 removes the residual toner prticles from the photoconductive surface of belt 10. During the second cycle, voltage source 56 electrically biases tubular member 50 to a potential greater than that of the latent image. Thus, during cleaning, voltage source 56 electrically biases tubular member 50 to a potential having a magnitude greater than the developing potential of the first cycle. In this way, the toner particles are attracted to the carrier granules adhering to tubular member 50. Thus, the residual toner particles are removed from the photoconductive surface and returned to the combined developing-cleaning unit for subsequent reuse.

After the residual toner particles have been cleaned from the photoconductive surface of belt 10, the residual charge thereon passes beneath combined exposing-discharging unit 36. At this time, a light shutter (not shown) permits light rays from light source 38 to be transmitted through fiber optic tube 44 onto the photoconductive surface. These light rays illuminate the photoconductive surface to remove any residual electrostatic charge remaining thereon prior to the charging thereof for the next successive cycle. During the first cycle, the shutter prevents light rays from light source 36 from being transmitted through tube 44.

Figure 2:
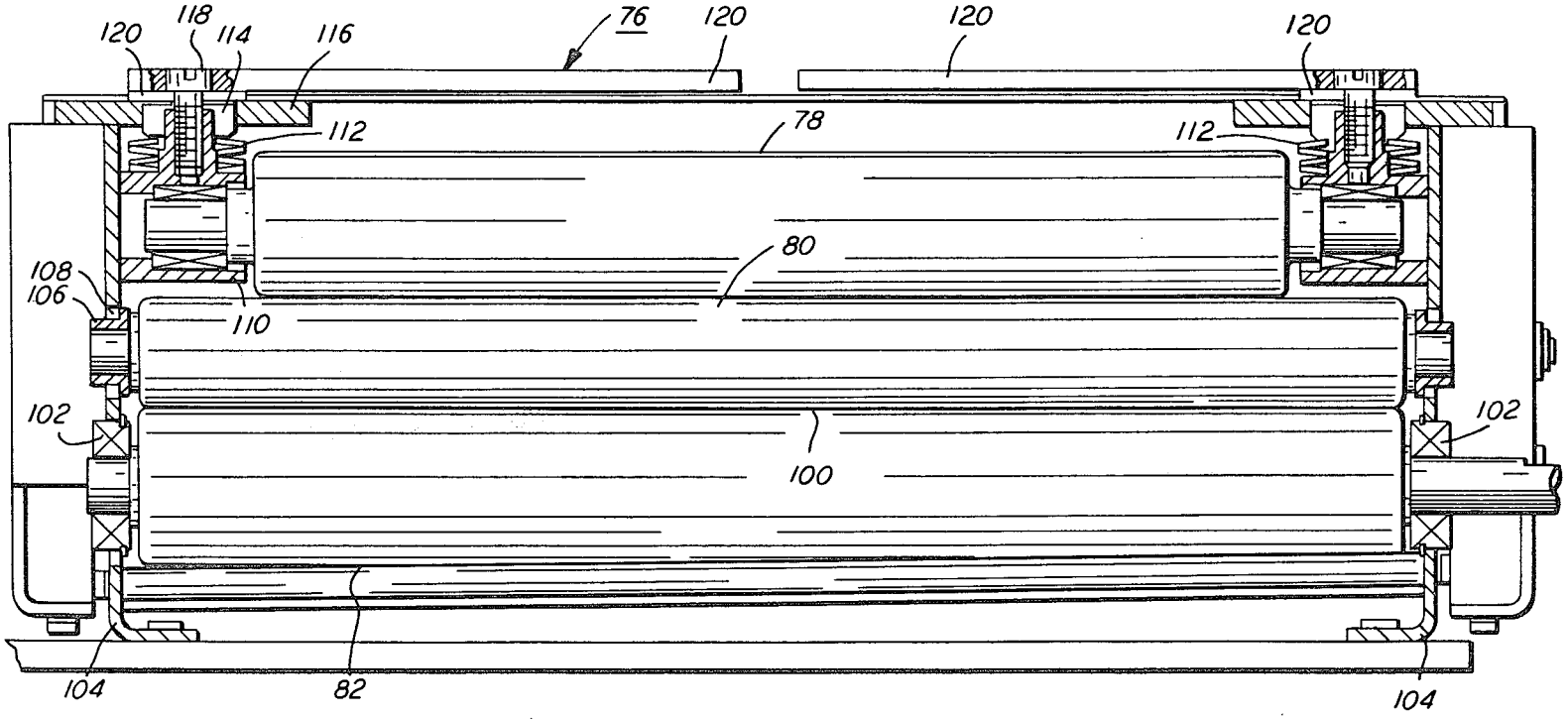
FIG. 2 is a front elevational view of a three roll pressure fuser representing the invention.

The fuser assembly 76 as noted comprises the three rolls 78, 80 and 82. These rolls may be fabricated from various materials, for example, steel, stainless steel or aluminum and they are preferably solid rolls. The fuser roller 82 contacts the images on the copy sheet as the sheet is moved through a nip 100 formed between the fuser roller 82 and the pressure roller 80. As shown in a front elevational view of the fuser 76 depicted in FIG. 2, the fuser roller 82 is journaled by means of suitable bearings 102 fixedly mounted in end frames 104. The pressure roller 80 is also journaled in the end frames 102 by means of sleeve bearings 106 such that its axis is parallel to that of the fuser roll 82. Vertical slots 108 are provided in each of the end frames 104 so that the pressure roll is floatingly mounted to permit it to be supported by the fuser roller and the pressures applied thereto via the backup roll 78 to be transmitted to the fuser roll 82 in order to create pressure in the nip for fusing the toner to the copy sheet solely by pressure. Toners which are suitable for fusing solely by pressure do not form a part of this invention therefore, a discussion and further reference to such toners will not be made. Moreover, such toners are well known in the art of xerography. The pressure and fuser rollers in a typical configuration have a 10.25 to 12 inch length and the diameter of the pressure roll is smaller than that of the fuser roll so that under load conditions there is conformability between the two rolls. The diameter of the pressure roll is preferably on the order of 60 to 88% of the diameter of the fuser roll.

The backup roller 78 which as can be seen is utilized for biasing the pressure roller 80 into pressure engagement with the fuser roller 82. To this end, the backup roller with its bearings is carried in movable or floating bearing blocks 110 which are, in turn, supported by the end frames 104. A pair of suitably calibrated spring washers 112 are provided for loading the backup roll against the pressure roller 80. One surface of the spring engages the top surface of its associated bearing block 110 while the other surface engages the undersurface of a load nut 114. In the loaded condition as viewed in FIGS. 2 and 3, the spring washers are compressed between the load nut and the bearing block to create the desired force on the backup roller to cause pressure engagement of the fuser and pressure rollers. The degree of compression of the springs which determines the force that will be exerted thereby is set by fixing the distance between the bottom of the load nut and the top of the bearing block. This is accomplished by screwing the load nuts into load plates 116 a predetermined amount depending on the force to be exerted, the load plates being fixedly mounted to the fuser frame.

The rolls are adapted to be loaded and unloaded by means load screws 118 screwed into bearing blocks 110 which serve to move the bearing blocks in the vertical direction in response to the angular rotation of actuator arms 120 which are attached to the load screws 118 and spaced from the load plates by load washers 120. Rotation of the arms 118 from the position shown in FIG. 2 acts to raise the bearing blocks which further compresses the spring washers 112 thus removing the load in the nip formed between the pressure and fuser rollers. Accordingly, in the event of a paper jam, the paper can readily be removed from the nip by removing the load in the nip in the foregoing manner.

Figure 3:
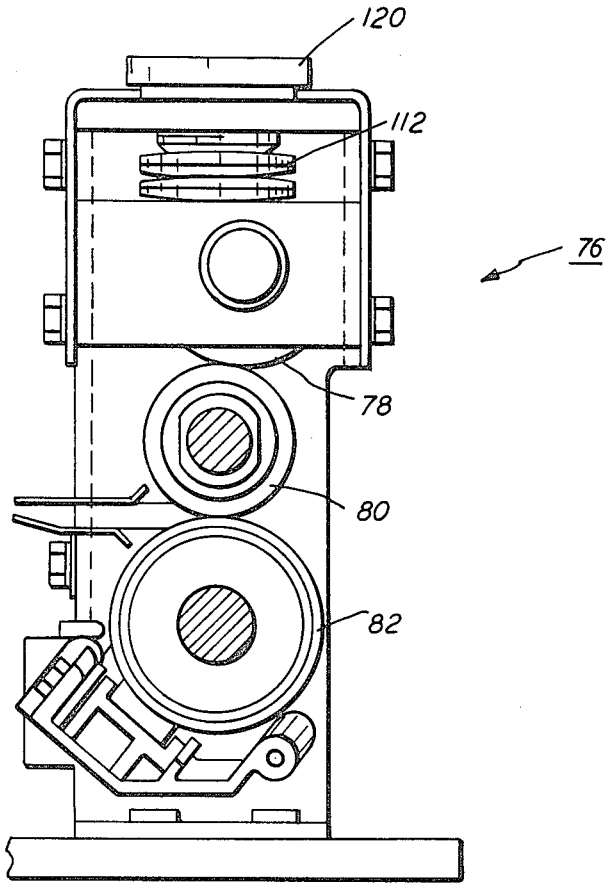
FIG. 3 is an end view of the fuser illustrated in FIG. 2.

As noted hereinabove, the axes of the rollers 80 and 82 are parallel. This is not the case with the backup roller 78. To the contrary, as can be seen in FIG. 3, the axis of the backup roller is overskewed with respect to the axes of the other two rolls. By overskewed, it is meant that axis of the backup roller is angulated with respect to the axis of the pressure roller such that the pressure between the backup roller and the pressure roller is peaked at the center and zero at the ends and such that this pressure is distributed over approximately 60% of the length of the pressure roller. While the load is applied over only approximately 60% of the length of the pressure roller it was found that it is distributed such as to optimize the deflection differences between a simply supported and a centrally supported beam and also eliminate the high stress concentration inherent in point application of high loads while effecting a substantially uniform load distribution in the nip 100. Substantially uniform nip pressure on the order of 4500–5000 psi is obtained with the foregoing arrangement. Uniformity is obtainable within ±5%. Pressures of 4500 to 5000 psi are ideal for pressure only systems such as disclosed herein. This concept is not limited to these pressures. Modifications of the roll diameters, material (Alvs Steel) and/or roll lengths will change the optimum pressure value. Therefore, the general configuration (overskewed load roll, 60% load distribution, and a pressure roll of 60–88% of the fuser roll) could be used over a range of operating pressures of 0–100,000 psi.

It should now be apparent that there has been shown and described a cold pressure fuser comprising three rollers one of which is overskewed relative to the other two such that there is zero load between the ends of the overskewed roller and the roller it contacts. It should also be apparent that effecting jam clearance has been facilitated in such a fuser by providing structure for removing the load between the rollers without affecting the calibration of the force loading mechanism.

I claim:

1. Fuser apparatus for fixing toner images to copy substrates solely by the application of pressure, said apparatus comprising:

frame structure;

a fuser roller and support bearings therefor, said support bearings being fixedly mounted in said frame structure;

a pressure roller adapted to form a nip with said fuser roll through which said substrate pass with said toner images contacting said fuser roller, said pressure roller being movably supported in said frame whereby it can be biased into pressure engagement with said fuser roll;

a backup roller mounted for engagement with said pressure roll for applying a load force thereto to thereby create pressure in said nip suitable for fusing toner images to copy sheets passing through said nip such that said toner images contact said fuser roller;

means for urging said backup roller into pressure engagement with said pressure roller, the axes of said fuser and pressure roller being parallel and said backup roller being overskewed with respect to the axes of said fuser and pressure rollers whereby the force distribution between said backup roller and said pressure roller is a maximum at the center of said backup roller and zero at its ends.

2. Apparatus according claim 1 wherein the force exerted by said pressue roller is operative over approximately 60% of the length of said pressure roller.

3. Apparatus according to claim 2 wherein the diameter of said pressure roller is on the order of 60–88% of said fuser roller.

4. Apparatus according to any one of claims 1, 2 or 3 including means for rendering said urging means ineffective to thereby substantially reduce the pressure between said fuser and pressure rollers.

5. Apparatus according to any one of claims 1, 2 or 3 wherein said urging means comprises a pair of springs engaging movable bearing blocks supporting the ends of said backup roller and adjustable nuts for compressing said springs between said nuts and said bearing blocks and wherein said nuts are fixedly mounted to said fuser.

6. Apparatus according to claim 4 wherein said means for rendering said urging means ineffective comprises a pair of screws and actuator arms therefor, said arms being movable from first positions where said springs are effective to cause pressure engagement between said backup and pressure rollers to second positions where said springs are ineffective to cause pressure engagement between said backup roller and said pressure roller.

* * * * *